United States Patent [19]

Petri

[11] Patent Number: 4,806,911

[45] Date of Patent: Feb. 21, 1989

[54] KEY-RING-MOUNTABLE ALARM DEVICE

[76] Inventor: Dan A. Petri, 4602 Scotts Valley Dr., Scotts Valley, Calif. 95066

[21] Appl. No.: 123,734

[22] Filed: Nov. 23, 1987

[51] Int. Cl.[4] ..... G08B 15/00

[52] U.S. Cl. ..... 340/574; 200/61.79; 200/61.80; 340/384 E

[58] Field of Search ..... 340/574; 200/61.79, 200/61.80; 340/384 E

[56] References Cited

U.S. PATENT DOCUMENTS

| | | | |
|---|---|---|---|
| 3,825,833 | 7/1974 | Bogue et al. | 340/574 |
| 4,158,197 | 6/1979 | Takagaki | 340/574 |
| 4,241,332 | 12/1980 | Farque | 340/326 |
| 4,284,982 | 8/1981 | Downey | 340/574 |
| 4,386,341 | 5/1983 | Yamamoto | 340/384 E |
| 4,404,549 | 9/1983 | Berg | 340/574 |
| 4,633,232 | 12/1986 | Nelson et al. | 340/574 |

*Primary Examiner*—Glen R. Swann, III

*Attorney, Agent, or Firm*—Townsend and Townsend

[57] ABSTRACT

A key-ring-mountable portable alarm device has a battery operated audible alarm and a triggering means having multiple modes of operation. The triggering means provides for momentary operation of the alarm, continuous operation of the alarm and reset of the alarm. The triggering means includes two slide activation mechanisms which interlock and serve together as an electrical switch controlling the battery circuit. The alarm is based on a square wave oscillator coupled to a piezo-electric loudspeaker having sufficient power to cause pain or discomfort to a human at close range. The fundamental of the output signal is selected to be in the range of optimum hearing, preferably between 2,000 Hz and 4,000 Hz.

4 Claims, 1 Drawing Sheet

KEY-RING-MOUNTABLE ALARM DEVICE

BACKGROUND OF THE INVENTION

1. Field of the Invention

This invention relates to personal protection systems and more particularly to a personal alarm system which can be mounted on a key ring.

Personal alarms which are battery operated and which employ audible alarms are well known. Personal alarms are provided in various guises, including as key ring fobs. One of the common problems with such alarms is the need for testing the usability of the device while avoiding accidental triggering of the alarm.

2. Description of the Relevant Literature

The following patents were uncovered in a search of prior art related to battery operated personal alarms:

U.S. Pat. No. 4,284,982 discloses a battery operated personal alarm with a withdrawable actuating pin.

U.S. Pat. No. 4,404,549 describes a latching portable personal security alarm which is intended to be carried on the belt of an operator and which has various individual activating switches which are push button and/or key operated in nature. A key is required to turn off the alarm.

U.S. Pat. No. 4,633,232 describes an alarm device which is activated after cocking by simply releasing a removable member which falls away. This alarm requires that the user hold it constantly to avoid undesired actuation.

U.S. Pat. No. 4,241,332 describes a personal security alarm incorporating a audible alarm and a high intensity flash lamp. Activation is by remote switch which can be deactivated only by a key switch on the alarm. This alarm does not appear to be designed to be carried on the person.

The above patents represent a sample of types of battery-operated personal security devices.

SUMMARY OF THE INVENTION

According to the invention, a key ring-mountable portable alarm device comprises a battery operated audible alarm with a triggering means having multiple modes of operation. The triggering means provides for momentary operation of the alarm, continuous operation of the alarm and reset of the alarm. The triggering means includes two slide activation mechanisms which interlock and serve together as an electrical switch controlling the battery circuit. The alarm is based on a square wave oscillator coupled to a piezo-electric loudspeaker having sufficient power to cause pain or discomfort to a human at close range. The fundamental of the output signal is selected to be in the range of optimum hearing, preferably between 2,000 Hz and 4,000 Hz.

The invention will be better understood by reference to the following detailed description in connection with the accompanying drawings.

DESCRIPTION OF SPECIFIC EMBODIMENTS

Figure 1:
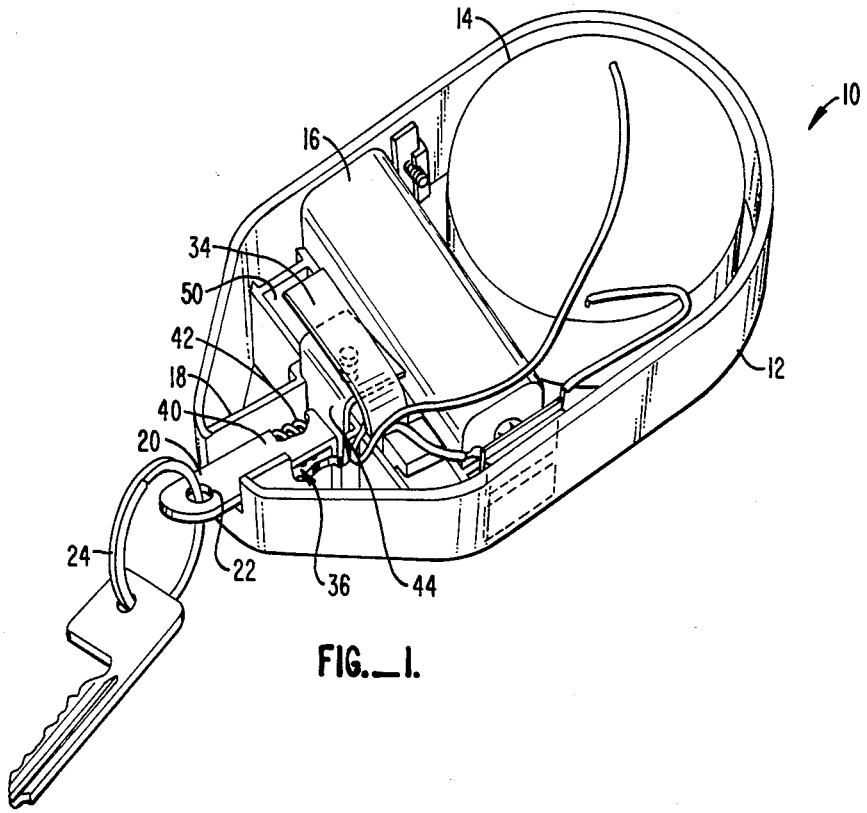
FIG. 1 is a perspective drawing in partial cutaway of the alarm device according to the invention.

Referring to FIG. 1, there is shown a perspective view of an alarm device 10 according to the invention in partial cutaway. The alarm device 10 comprises a housing 12, a loudspeaker and square wave oscillator module 14, a battery 16, and a triggering means 18. The housing 12 encloses the module 14, the battery 16, and the triggering means 18 with the exception of an extension 20, which includes a hole 22, for a key ring 24. The extension 20 is nonremovable.

Figure 2:
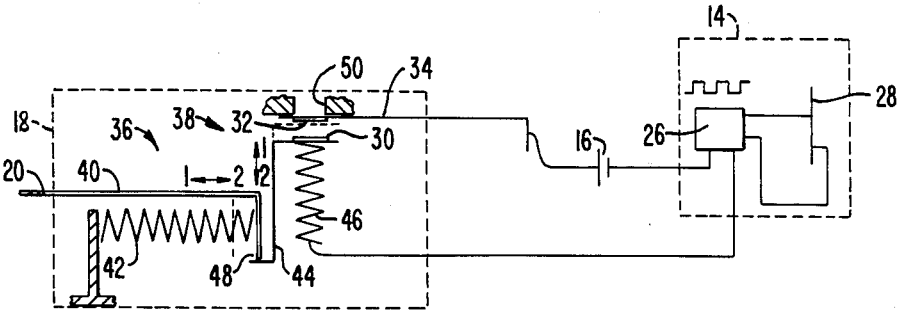
FIG. 2 is a schematic diagram of a circuit according to invention.

Referring to FIG. 2 in connection with FIG. 1, the module 14 comprises a square wave oscillator 26 coupled to a piezo-electric loudspeaker 28, which is a disk of a piezo-electric material having one surface electrically connected to one pole of the oscillator 26 and the opposing surface electrically connected to the other pole of the oscillator 26.

The triggering means 18 includes a first electrical contact 30 and a second electrical contact 32, in juxtaposition to one another as explained hereinafter. The battery 16 is coupled at one terminal to the oscillator 26 and at the other terminal through a leaf spring member 34 to the second electrical contact 32. A second terminal of the oscillator 26 is coupled to the second electrical contact 30, either directly or through an intermediate element.

The triggering means 18 comprises a first activation means 36 and a second activation means 38. The first activation means 36 comprises the extension 20, which forms a part of a first slide member 40, and a first spring 42. The slide member 40 is movable between a first position and a second position, the first spring 42 biasing the slide member 40 toward the second position.

The second activation means 38 comprises the leaf spring 34, contacts 30 and 32, a second slide member 44, and second spring 46. The second slide member 44 is movable between a first position and a second position, and the second spring 46 biases the second slide member 44 toward the first position, where, if unrestrained, the second slide member 44, to which the first contact 30 is mounted, would engage the second contact 32 mounted on the leaf spring member 34. However, the second slide member 44 includes an engagement portion 48 which is for engaging the first slide member 40 in its second position. The first slide member 40 may nevertheless be moved toward its first position by drawing on the extension 20.

The electrical terminal of the oscillator 26 may be connected through the second spring member 46 to the first electrical contact 30 if the second spring member 46 is electrically conductive. Otherwise, the contact 30 is directly wired to the oscillator 26.

The first slide member 40 and the second slide member 44 are typically arranged in a transverse or preferably perpendicular relationship so that the respective positions move perpendicular to one another. In this manner, the extension 20 can be drawn along one axis out of the housing 12 and the second slide member 44 can move along another axis across the housing 12.

The leaf spring member 34 is accessible by a slot opening 50 in the housing 12 permitting a tool to be inserted to move the leaf spring member 34 to engage the contacts and also to cause the second slide member 44 to move from its first position toward its second position.

In operation, the alarm device is cocked or set by moving the leaf spring 34 into contact with the second slide member 44, forcing the second slide member 44 to move from its first position to its second position. At the second position of the second slide member 44, the first slide member 40 is released and allowed to move from its first position into its second position, engaging the second slide member 44 at the engagement portion 48. In this position, momentary contact can be made between the leaf spring 34 and the second slide member 44 at the contacts 32 and 30 upon placement of a tool through the opening 50. This permits testing of the alarm with momentary contact.

The testing and the setting of the device comprise two modes of operation of the trigger means 12. The alarm is activated with a latch by withdrawing the extension 20 causing the first slide member 40 to move between its second position and its first position, thereby releasing the engagement portion 48 allowing the second slide member to move from its second position into continuous contact with the leaf spring 34 in the first position of the second side member 44. The alarm is thereby activated by closure of the battery circuit. The oscillator 26 generates a signal with a frequency of its fundamental between 2,000 Hz and 4,000 Hz, and preferably about 3,000 Hz, or otherwise in the optimum hearing range of the human ear. The oscillator 26 generates sufficient power to cause the piezo-electric speaker 28 to generate an audible signal which is sufficient to cause discomfort or pain in a human at close distance. This noise level is a minimum of 105 dB at 50 cm. distance from the face of the loudspeaker. The alarm remains activated until the battery is expended or the device is reset.

The device is reset by applying pressure against the leaf spring 34 through the external opening 50 sufficient to move the second slide member 44 from its first position into its second position to allow the first slide member 40 to move from its first position to its second position in engagement with the engagement portion 48.

In one embodiment of the invention, the leaf spring 34 provides a surface which in its normal position engages the surface surrounding the opening 50, thereby sealing the opening 50 against intrusion by foreign objects. Similarly, the opening for the extension 20 is sufficiently small to prevent intrusion by foreign objects.

The invention has now been explained with reference to specific embodiments. Other embodiments will be apparent to those of ordinary skill in the art. It is therefore not intended that this invention be limited except as indicated by the appended claims.

I claim:

1. A key-ring-mountable portable alarm device comprising:

a housing;

a piezo-electric loudspeaker mounted within said housing:

a square-wave oscillator mounted within said housing and coupled to said loudspeaker for driving said loudspeaker, said square-wave oscillator operative with a fundamental frequency in the range of peak hearing of a human and with a minimum power output to said loudspeaker sufficient to cause pain in the ear of a human;

a battery mounted within said housing and having a normally-broken continuity; and a triggering means having a first mode of operation, a second mode of operation and a third mode of operation, said first mode of operation coupling said battery to said square-wave oscillator for extended operation of said square-wave oscillator, said second mode of operation for momentary operation of said battery, square-wave oscillator and said loudspeaker, and said third mode of operation for terminating said first mode of operation, said triggering means comprising a first activation means mechanically coupled to a key ring and a second activation means incorporating an electrical switch for proving continuity in a battery circuit through said battery and said oscillator, said second activation means being normally mechanically held by said first activation means in a normally open contact position, said second activation means including means for terminating first mode of operation.

2. The device according to claim 1 wherein said triggering means comprises:

a first slide member and a first spring as said first activation means;

a second slide member slidably moveable between a first position sand second position, a second spring and a leaf spring member as said second activation means;

said first slide member being connected to said first spring and being biased into contact with said second slide member by said first spring;

said second slide member comprising a first electrical conductor in electrical contact with a first pole of said battery circuit and having an electrical contact in juxtaposition with said leaf spring member, said second slide member further comprising an engagement portion which in said first position engages said first slide member such that said first slide member holds said second slide member in separation from said leaf spring member and in said second position allows contact between said first electrical contact and a second electrical contact;

said leaf spring member having said second electrical contact in juxtaposition with said first electrical contact and being electrically connected to a second pole of said battery circuit, said leaf spring member being exposed to receive through an opening in said housing a tool, sand leaf spring being moveable to press against said second slide member in order to momentarily contact said first contact to close said battery circuit in said second mode of operation and to cause said second slide member to move to said first position in said third mode of operation.

3. The device according to claim 1 wherein said square-wave oscillator is operative with a fundamental frequency in a range of between 2000 Hz and 4000 Hz.

4. The device according to claim 1 wherein said minimum power output to said loudspeaker sufficient to cause pain in the ear of a human at close range is 105 dB at 50 cm.

* * * * *